United States Patent [19]

Kasboske

[11] Patent Number: 4,586,116

[45] Date of Patent: Apr. 29, 1986

[54] VEHICLE HEADLAMP WITH YELLOW AND MAIN LIGHT TRANSMISSION

[76] Inventor: George C. Kasboske, 2820 N. Whipple, Chicago, Ill. 60618

[21] Appl. No.: 653,437

[22] Filed: Sep. 21, 1984

[51] Int. Cl.[4] ..... F21V 9/00

[52] U.S. Cl. ..... 362/293; 362/61; 362/310; 362/300; 362/328; 362/303; 362/333; 362/308; 362/335; 362/350; 362/375

[58] Field of Search ..... 362/293, 303, 333, 336, 362/61, 300, 310, 328, 308, 335, 350, 375

[56] References Cited

U.S. PATENT DOCUMENTS

| | | | |
|---|---|---|---|
| 2,304,861 | 12/1942 | Thee | 362/317 |
| 2,489,172 | 11/1949 | Brandt | 362/361 X |
| 2,756,325 | 7/1956 | Zwick | 362/332 |
| 3,754,135 | 8/1973 | Hulbert, Jr. | 362/303 X |
| 4,142,229 | 2/1979 | Hulbert, Jr. | 362/309 X |
| 4,209,825 | 6/1980 | Shackelford | 362/303 X |

*Primary Examiner*—Peter A. Nelson

*Attorney, Agent, or Firm*—Wood, Dalton, Phillips, Mason & Rowe

[57] ABSTRACT

According to the invention clear and yellow transparent zones are provided on the surface of a light diffusing element associated with a headlamp for a moving vehicle. The light emitted from the lamp has the characteristics of both white and yellow light. High intensity white light provides satisfactory illumination for highway driving, while the yellow light emitted penetrates fog, dust and/or smoke better than the ordinary white light. The benefits of both light are realized with a single lamp. The coloration of the light diffusing member can be accomplished by treating a conventional white light headlamp.

9 Claims, 3 Drawing Figures

VEHICLE HEADLAMP WITH YELLOW AND MAIN LIGHT TRANSMISSION

BACKGROUND ART

1. Field of the Invention

This invention relates to headlamps for moving vehicles and, more particularly, to a high intensity lamp with excellent penetrating capabilities in fog, dust, snow, rain and/or smoke.

2. Background of the Invention

Conventional sealed beam headlamps, used on automobiles and other high speed vehicles, employ a filament to project white light through a clear, light-diffusing element, which is typically glass. Many competing objectives come into play in headlamp design. A high intensity lamp that clearly illuminates a highway far in front of a moving vehicle, subjects oncoming traffic to the glaring brightness of the unconcealed filament. Further, fog, dust, snow, rain and/or smoke tend to reflect high intensity white light which may blind the vehicle operator. As an alternative to white light lamps, fog lamps, which develop yellow light that penetrates fog, dust, snow, rain and/or smoke effectively, normally do not alone have the intensity to satisfactorily illuminate a roadway at high speeds with unobstructed visibility.

It has heretofore been common to incorporate both white sealed beam headlamps and fog lamps on the same vehicle. This results in the provision of at least four headlamps which is expensive from a manufacturing standpoint and to the consumer who must replace entire lamps as each of the lamps burns out.

SUMMARY OF THE INVENTION

The present invention is specifically directed to overcoming the above enumerated problems in a novel and simple manner.

According to the invention, a light-diffusing element associated with a headlamp is partially colored yellow or amber. The resulting light emission in the yellow wavelength range is superior to white light in its ability to penetrate fog, smoke, snow, rain and/or dust.

It is the principal objective of the invention to provide a headlamp that serves both as a high intensity light for satisfactory illumination of a roadway in front of a rapidly moving vehicle in clear weather and at the same time one that will have good penetrating characteristics under adverse conditions. The mixture of white and yellow light from a single lamp inexpensively accounts for this capability.

The invention contemplates providing a yellow colored zone over less than the entire diffusing area of the light-diffusing element. The colored zone can be formed integrally with the light diffusing element or can be prepared by treating conventional sealed beam lamps. The zone of coloration can be established by painting with a non-metallic paint, adhering a decal, etching the glass or in any other suitable manner that results in permanent transparent coloration of the light diffusing element.

Other objects and advantages of the invention will become apparent upon reviewing the following detailed description, the claims and the appended drawings.

DETAILED DESCRIPTION OF THE DRAWINGS

Figure 1:
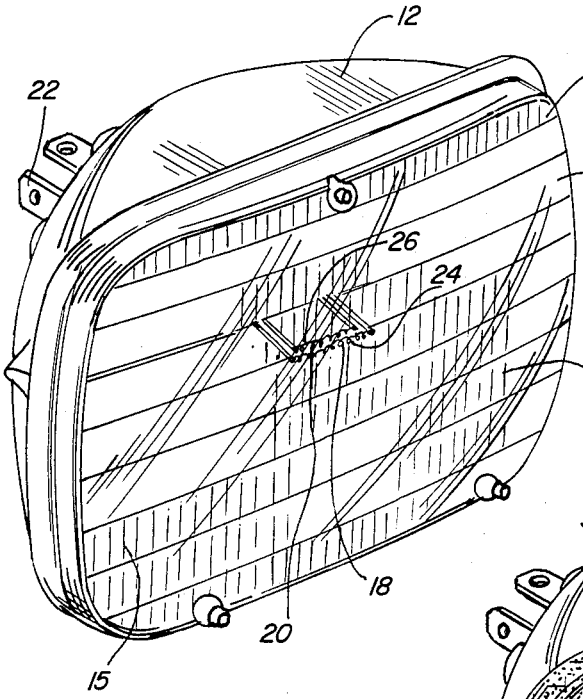
FIG. 1 is a perspective view of a conventional, sealed beam headlamp.

A conventional sealed beam headlamp is depicted in FIG. 1 at 10. The headlamp 10 comprises a housing 12 with a paraboloidal configuration enclosed by a glass, light-diffusing element 14. The housing 12 may be metal or glass that is silvered for reflection by a thin coating of aluminum or the like as a vapor in vacuum. The reflective, inside surface 16 of the housing concentrates light emitted from high beam and low beam filaments 18, 20 respectively. The reflecting surface 16 of the housing is associated with the filament so that all the rays emitted from the filaments at the focus of the housing are reflected in a direction parallel to the axis of the reflector.

The light-diffusing glass element 14 has grooves or ribs 15 which act as prisms in deflecting the light. The ribs 14 distribute light to the sides of the vehicle to enlarge the operator's field of vision. At the same time this light dispersion reduces brightness of the beam in the travel direction.

The high beam and low beam filaments are selectively illuminable by the vehicle operator. Separate connection of the low and high beam filaments is established by filament leads 22 which are supplied by the vehicle voltage source.

The brightness of the bulb for high beam operation is realized by locating a tungsten coil 24 on the high beam filament 18 as close to the focus of the reflecting surface 16 as possible. A tungsten coil 26 on the low beam filament 20 is located a few millimeters in front of the focus and slightly higher so that light emitted thereby is reflected as a downwardly directed, spreading beam. Upwardly reflecting light is intercepted by a screen (not shown) under the filaments.

Since the 1950's, it has become common for car manufacturers to provide four headlights for improved illumination. The outer lamps are the double-filament type previously described. The inner lamps have a single-filament high beam of high wattage to produce a spotlight effect. The low beam of the two outer lamps focused toward the right and used when meeting other vehicles head on or when overtaking a vehicle. With no approaching traffic, all four high beam lamps can be safely utilized.

It has been common to employ, in addition to the two or four white light headlamps on standard vehicles, two fog lights that are situated below the white headlamps and between the single-filament high beam lamps. The fog lamps generally are also the single-filament type and may be constructed as sealed beams. The sealed beam white headlamps and fog lamps, because of the aforementioned assembly, must be removed and replaced as an entire unit in the event that the filaments become defective.

The fog lamps produce low intensity light but have high penetration capabilities. On the other hand, the white light lamps produce high intensity light but have poor penetration capabilities in adverse weather. The present invention obviates the need for separate fog and white light lamps.

Figure 2:
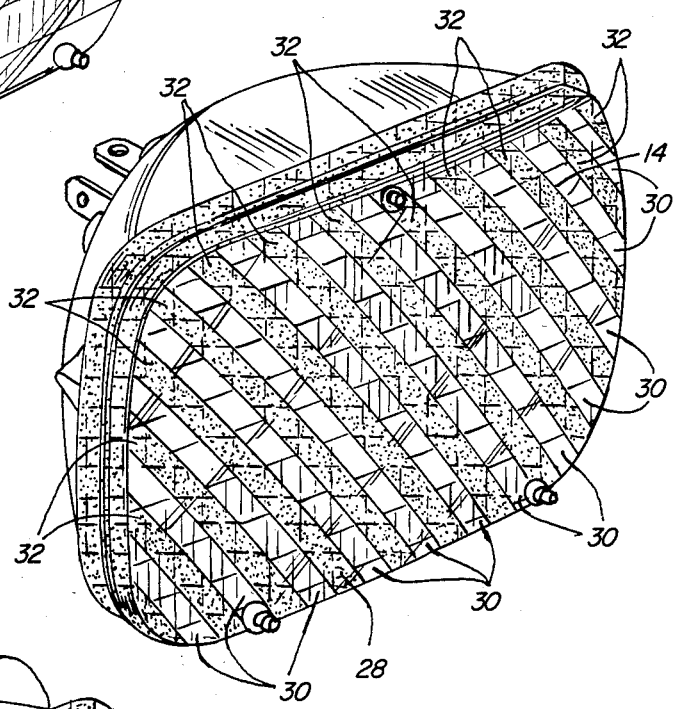
FIG. 2 is a perspective view of the lamp of FIG. 1 improved according to the present invention.
Figure 3:
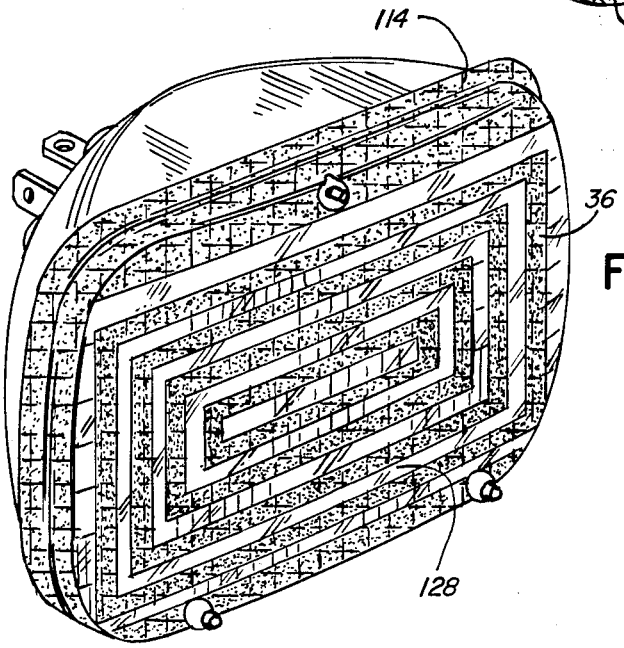
FIG. 3 is a perspective view of the headlamp of FIG. 1 improved in an alternative manner according to the present invention.

According to the invention, as described with relation to FIGS. 2 and 3, a light diffusing element 14 is partially colored so that both white and yellow light emanate from the same lamp. Several different techniques may be practiced to treat the light-diffusing element according to the present invention.

In a preferred form, the front surface 28 of the light diffusing element 14 is masked in zones 30 that are intended to diffuse primarily white light. The zones 30 are spaced, parallel strips masked by the width of a self-adhesive tape. A suitable tape is manufactured by Minnesota Mining and Manufacturing Co. and identified by their trademark FINE-LINE. This tape has a width of approximately ¼". The resulting pattern is a series of alternating masked and unmasked zones of substantially equal width. The result is that approximately 50% of the surface 28 of the light diffusing element is masked.

The unmasked zones 32 are then sandblasted to roughen the surface of the light-diffusing element to enhance its ability to sustain paint. The painting is accomplished with a dusting gun with an amber or yellow paint. A suitable color is manufactured by Ditzler and identified as "Amber Glow". The Ditzler paint is mixed without the recommended metallic additive to reduce the possibility of the paint flaking and to enhance the transparency of the paint. After the paint is applied, it can be heat dried by an external source or by illuminating the lamp. Other highly transparent paints would result in light emission consistent with the invention.

As an alternative to the masking process described above, the preparation of a surrounding boot (not shown) with material eliminated strategically to permit sandblasting in the zones to the colored, might be used. The use of a stencil would also facilitate manufacture on a mass basis.

As an alternative to the painting process, a decal in the desired configuration might be applied to the outer surface of the light-diffusing member. Microthin decals for application on glass are known in the art and are applied by a heat flashing procedure which results in a permanent bond on the surface of the lamp. A still further alternative to sandblasting and the use of decals is acid etching.

The resulting lamp surface 28 has alternating white and yellow or amber colored zones. The result is that both white light and yellow light are emitted from the lamp, with the advantages of both lights realized with the same structure.

The applicant has tested the improved structure in FIG. 2 side-by-side with conventional fog lamps, normal white light lamps and a halogen lamp. The applicant has observed that the intensity of the improved lamp is increased over a comparable fog lamp construction. The offensive glare associated with the conventional white light lamps is substantially eliminated with the improved structure when observed head on. Further, the penetration capability under adverse conditions has been noticeably improved over conventional white light lamps.

The applicant believes from experimentation, that the optimum operating characteristics with the improved structure are realized with the white and colored light zones occupying each about 50% of the surface of the light-diffusing member. The precise pattern of the zones is not critical. An alternative pattern for the colored zones is depicted in FIG. 3. A continuous colored strip is arranged in a circuitous path on the front surface 128 of the light-diffusing member 114.

The foregoing detailed description was made for purposes of demonstrating the structure and operation of the present invention, with no unnecessary limitations to be understood therefrom.

I claim:

1. An improved vehicle headlamp of the type having a housing with a light-reflecting surface, a source of illumination and a light-diffusing element, the improvement comprising: said light-diffusing element having a first transparent, masked, yellow-colored zone containing at least 3 spaced and distinct yellow light-transmitting portions from which a first primarily yellow light emanates and a second transparent zone through which a second light different from the first light emanates with the source of illumination activated, said first light affording effective penetration of fog, dust, snow, rain and/or smoke.

2. The improved vehicle headlamp according to claim 1 wherein the second zone is substantially clear.

3. The improved vehicle headlamp according to claim 2 wherein the light-diffusing element has an area through which the light from the illumination source passes and each of the first and second zones take up approximately one-half the area of the light-diffusing element.

4. An improved vehicle headlamp of the type having a housing with an inside light-reflecting surface, a source of white light and a substantially clear light-diffusing element being provided with at least 3 spaced and distinct transparently masked, yellow-colored areas so that light transmitted through said element from the illumination source is a mixture of distributed white and yellow-colored light portions.

5. The improved vehicle headlamp according to claim 4 wherein said colored areas are painted with a non-metallic yellow paint.

6. The improved vehicle headlamp of claim 4 wherein a transparent decal is placed over the light-diffusing element.

7. The improved vehicle headlamp of claim 4 wherein said colored areas are defined by colored stripes on the light-diffusing element.

8. The improved vehicle headlamp of claim 4 wherein said colored areas are defined by a continuous colored line arranged in a circuitous path on the light-diffusing element.

9. An improved vehicle headlamp of the type having a housing with a light-reflecting surface, a source of illumination and a light-diffusing element, the improvement comprising the construction of said light-diffusing element to define a first transparent, masked yellow-colored portion containing at least three spaced and distinct portions through which primarily yellow-colored light is transmitted and a second transparent portion through which a second light different from the first light is transmitted as a result of said source of illumination being activated, said first light having illuminating characteristics affording effective penetration of fog, dust, snow, rain and/or smoke and said first and second portions cooperatively providing a distributed combination light satisfactory for use of the headlamp as the normal headlamp of the vehicle under clear atmospheric conditons.

* * * * *